US006005543A

United States Patent [19]

Kimura

[11] Patent Number: 6,005,543

[45] Date of Patent: Dec. 21, 1999

[54] LIQUID CRYSTAL DISPLAY DEVICE AND METHOD OF DRIVING THE SAME

[75] Inventor: Hiroyuki Kimura, Hyogo-ken, Japan

[73] Assignee: Kabushiki Kaisha Toshiba, Kawasaki, Japan

[21] Appl. No.: 09/023,711

[22] Filed: Feb. 13, 1998

[30] Foreign Application Priority Data

Feb. 21, 1997 [JP] Japan ..... 9-037286
Jan. 27, 1998 [JP] Japan ..... 10-013701

[51] Int. Cl.[6] ..... G09G 3/36

[52] U.S. Cl. ..... 345/94; 345/90

[58] Field of Search ..... 345/87, 88, 89, 345/90, 91, 92, 93, 94, 95, 96, 97, 98, 99, 100, 103; 349/96, 38, 39, 34, 35, 36

[56] References Cited

FOREIGN PATENT DOCUMENTS

WO 95/02847 1/1995 WIPO .

*Primary Examiner*—Xiao Wu

*Attorney, Agent, or Firm*—Oblon, Spivak, McClelland, Maier & Neustadt, P.C.

[57] ABSTRACT

A liquid crystal display device includes an array substrate having a plurality of pixel electrodes in a matrix form, a counter substrate having a counter electrode opposed to the pixel electrodes, a liquid crystal layer including liquid crystal molecules disposed between the array and counter substrate, a first and second alignment layers, the first alignment layer disposed between the array substrate and the liquid crystal layer, the second alignment layer disposed between the counter substrate and the liquid crystal layer, and each of which are treated so as to give a predetermined pre-tilt angle to the liquid crystal molecules, and a shield electrode disposed a region applied a lateral electric field which is against to a direction of the pre-tilt angle. A potential difference between the shield electrode and the counter electrode is adjusted to a first potential difference during a first period, and the potential difference between the shield electrode and the counter electrode is adjusted to a second potential difference, which is smaller than the first potential difference, during a second period continuing after the first period so as to apply an alternating current voltage between the counter electrode and the shield electrode.

16 Claims, 8 Drawing Sheets

LIQUID CRYSTAL DISPLAY DEVICE AND METHOD OF DRIVING THE SAME

BACKGROUND OF THE INVENTION

1. Technical Field of the Invention

This invention relates to a liquid crystal display device that has a pair of substrates and a liquid crystal layer as an optical modulating layer therebetween, and a method of driving the same.

2. Discription of the Related Art

In recent years, taking advantage of their thinness, light weight and low power consumption, liquid crystal display devices have been used in various fields as display devices for personal computers, word processors, and also as projection type display devices.

Active matrix type display devices having pixel electrodes, each of which is connected with a switching element respectively, can realize an excellent display image without crosstalk between adjacent display pixels, and have been studied and developed vigorously.

Herein after, it will be briefly explained that a construction, for instance, of a light transmission type active matrix liquid crystal display device. This liquid crystal display device provides an array substrate, a counter substrate, a liquid crystal layer coupled with alignment layers on each substrates.

The array substrate, for instance, provides a plurality of signal and scanning lines in a matrix form, thin film transistors (TFTs) as a switching element formed at the vicinity of each crossing points thereof, and pixel electrodes made of I.T.O.(Indium Tin Oxide) connected with the switching elements on a glass substrate.

The counter substrate provides a light shielding layer formed on a glass substrate so as to shield a light passing through peripheral areas of pixel electrodes and a light irradiating toward the TFTs, and a counter electrode made of I.T.O. and formed on the light shielding layer via an insulating layer.

Now, regarding to each display pixels of this liquid crystal display device, a pixel electrode potential (Ve) of the display pixel changes under the influence of a leak current through the TFT and parasitic capacities of the TFT. Therefor, it is necessary to provide a storage capacitor (Cs) parallel to the liquid crystal capacity (Clc) so as to reduce the pixel electrode potential change, and the following two structures are well known.

The first structure is that the storage capacitors (Cs) are constructed with storage capacitor lines arranged in parallel with the scanning lines on the grass substrate of the array substrate, the pixel electrodes of which a part is overlapped with the storage capacitor lines respectively, and an insulating layer formed therebetween.

The second structure is that the storage capacitors (Cs) are constructed with the scanning lines, the pixel electrodes of which a part is overlapped with the neighboring scanning lines, and an insulating layer formed therebetween.

The second structure has an advantage to realize a high aperture ratio comparing to the first structure because of its arrangement without the independent storage capacitor lines.

In the liquid crystal display device mentioned above, it has been known that reverse image regions, which can not be controlled to the normal display state, have occurred in area where lateral electric fields between electrodes on the array substrate are against a pre-tilt direction of liquid crystal molecules, and the liquid crystal molecules are aligned along with the lateral electric fields.

In FIG. 7, 103, 111, 121, and 151 indicate signal lines, scanning lines, and TFTs, respectively. A solid and dot arrow lines indicate rubbing treatment directions of alignment layers on the array and counter substrates, respectively. And a twisted nematic (TN) liquid crystal layer including liquid crystal molecules is held between the substrates and the liquid crystal molecules is twisted at 90 degrees between the substrates.

The lateral electric fields which are against the pre-tilt direction of the liquid crystal molecules have occurred between the pixel electrodes 151, and the signal and scanning lines 103 and 111 and the pixel electrode 151 adjacent thereto, and an oblique line region in this Figure becomes a reverse image region.

It will be understood by this Figure that the reverse image region may extend in the pixel electrode 151 in accordance with an intensity of the lateral electric fields.

To eliminate the occurrence of the reverse image regions, it has been known that a liquid crystal display device, for instance, provides the scanning lines each of which comprises an extended portion extended between the signal line and pixel electrode electrically shielding the lateral electric field generated therebetween.

The inventors have newly found out by their own study and investigation that the occurrence of the reverse image regions can not be eliminated, even if the structure mentioned above is introduced.

SUMMARY OF THE INVENTION

This invention overcomes the above technical problems. One object of the present invention is to provide a liquid crystal display device to obtain both of a high aperature ratio and high display dignity without the riverce image region. Another object of the invention is to provide a liquid crystal display device reduced a gap between the pixel electrodes and the signal and scanning lines, or between adjacent pixel electrodes without the reverce image region. Another object of the present invention is to provide a method of driving a liquid crystal display device to obtain both of a high display dignity and a high aperture ratio without the reverce image region.

According to the present invention, there is provided a liquid crystal display device having an array substrate having a plurality of signal lines, a plurality of scanning lines crossing to the signal lines, switching elements disposed at each crossing points of the signal and scanning lines connected with one of the signal lines and one of the scanning lines, pixel electrodes each connected with one of the switching elements, a counter substrate having a counter electrode opposed to the pixel electrodes, a liquid crystal layer including liquid crystal molecules disposed between the array and counter substrate, a first and second alignment layers, said first alignment layer disposed between the array substrate and the liquid crystal layer, said second alignment layer disposed between the counter substrate and the liquid crystal layer, and each of which are treated so as to give a predetermined pre-tilt angle to the liquid crystal molecules, a signal line driver circuit for applying signal voltages to each signal lines, a scanning line driver circuit for applying scanning voltages to each scanning lines, a counter electrode driver circuit for applying a counter electrode voltage to the counter electrode, a shield electrode disposed a region applied a lateral electric field which is against to a direction of the pre-tilt angle, and control means for adjusting a potential difference between the shield electrode and the counter electrode to a first potential difference during a first period, and adjusting the potential difference between the shield electrode and the counter electrode to a second potential difference, which is smaller than the first potential difference, during a second period continuing after the first period.

According to the present invention, there is provided a method of driving a liquid crystal display device an array substrate having a plurality of pixel electrodes in a matrix form, a counter substrate having a counter electrode opposed to the pixel electrodes, a liquid crystal layer including liquid crystal molecules disposed between the array and counter substrate, a first and second alignment layers, said first alignment layer disposed between the array substrate and the liquid crystal layer, said second alignment layer disposed between the counter substrate and the liquid crystal layer, and each of which are treated so as to give a predetermined pre-tilt angle to the liquid crystal molecules, and a shield electrode disposed a region applied a lateral electric field which is against to a direction of the pre-tilt angle, comprising the steps of: applying signal voltages to each of the pixel electrodes respectively and applying a counter electrode voltage to the counter electrode in each predetermined periods; holding potential differences between each pixel electrodes and counter electrode during each predetermined holding periods, the potential differences associated with the signal and counter voltages; and displaying an image corresponding to the potential differences; wherein a potential difference between the shield electrode and the counter electrode is adjusted to a first potential difference during a first period, and the potential difference between the shield electrode and the counter electrode is adjusted to a second potential difference, which is smaller than the first potential difference, during a second period continuing after the first period.

In the liquid crystal display device and method of driving the same according to this invention, the potential difference between the shield electrode and the counter electrode is adjusted to a first potential difference during a first period, and the potential difference between the shield electrode and the counter electrode is adjusted to a second potential difference, which is smaller than the first potential difference, during a second period continuing after the first period. Therefore, the occurrence of the reverse image region under the influences of the lateral electric fields is prevented during the long periods.

DESCRIPTION OF THE PREFERRED EMBODIMENT

Now, we will briefly explain a problem of a prior driving method, before explanation of the embodiments of this invention which relates to a liquid crystal display device and a driving method thereof.

As mentioned above, we will explain where the liquid crystal display device provides an extended portion extended from the scanning line to the gap between the pixel electrode and the signal line so as to decrease the influences of the lateral electric fields.

Figure 8:
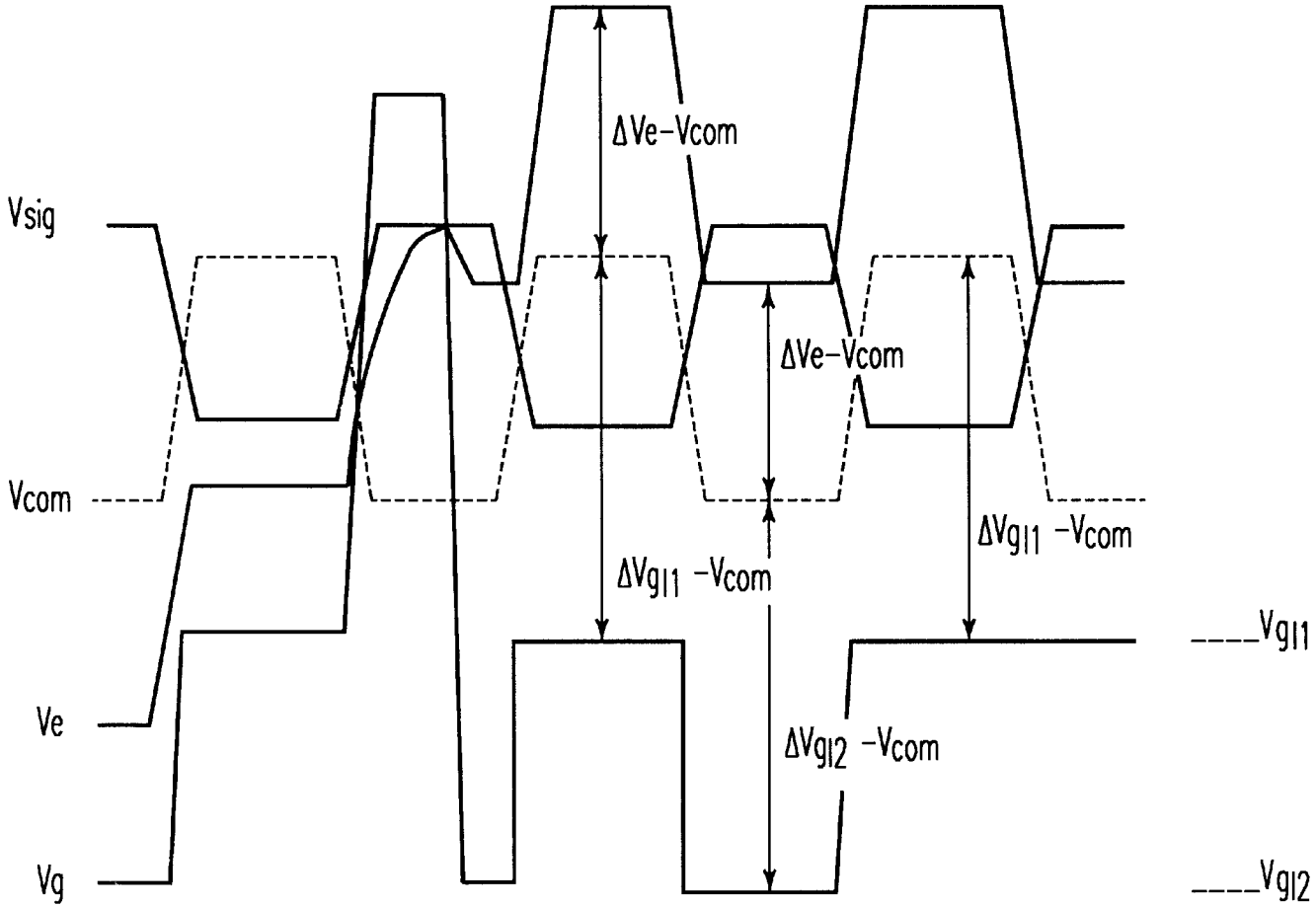
FIG. 8 shows driving waveforms of the prior liquid crystal display device.

FIG. 8 shows waveforms of a 1 H common inversion driving method accomplished by a signal voltage Vsig and a common electrode voltage Vcom, whose polarities are inverted to each reference (center) voltages at each horizontal scanning periods so as to reduce the amplitude of the signal voltage Vsig.

In general, the amplitude of the common electrode voltage Vcom is always equal to the amplitude Δ (Vgl1−Vgl2) of the scanning line voltage Vg during the holding period. The reason is to maintain the same potential difference Δ (Ve−Vcom) between the pixel electrode and the common electrode during the holding period.

In other words, the difference between the potential differences Δ (Vgl1−Vcom) and Δ (Vgl2−Vcom) are always equal. Therefore, a fixed direct current voltage is applied to the liquid crystal layer held between the extend portion and the common electrode all the time.

The liquid crystal molecules located in a region applied to the fixed direct current voltage between the extended portion and the common electrode are aligned along with a direction of the electric field in the first stage. There are no problems in normally-white mode liquid crystal display devices, because black images are displayed in that region.

We do not clarify the reason, however, under a high temperature environment or as time passes, a phenomenon that the vertical electric fields can not be applied to the liquid crystal layer located between the extended portion and the common electrode is occurred because of the spontaneous polarization of the alignment layer under the influences of the direct current voltage. Therefore, the liquid crystal molecules are to be affected sensitively by weak lateral electric fields, and the liquid crystal molecules may be easily reversed along with the lateral electric fields.

Accordingly, in this invention, an alternating current voltage instead of the direct current voltage is applied between the common electrode and the electrode to shield the lateral electric fields so as to reduce the occurrence of the reverse image regions. In this invention, the alternating current voltage may be applied in continuing ten holding periods, preferably in each holding periods, further preferably two horizontal scanning periods.

We will explain an active matrix type liquid crystal display device which is a normally-white mode projection type display device relating to one embodiment of the present invention in detail.

Figure 1:
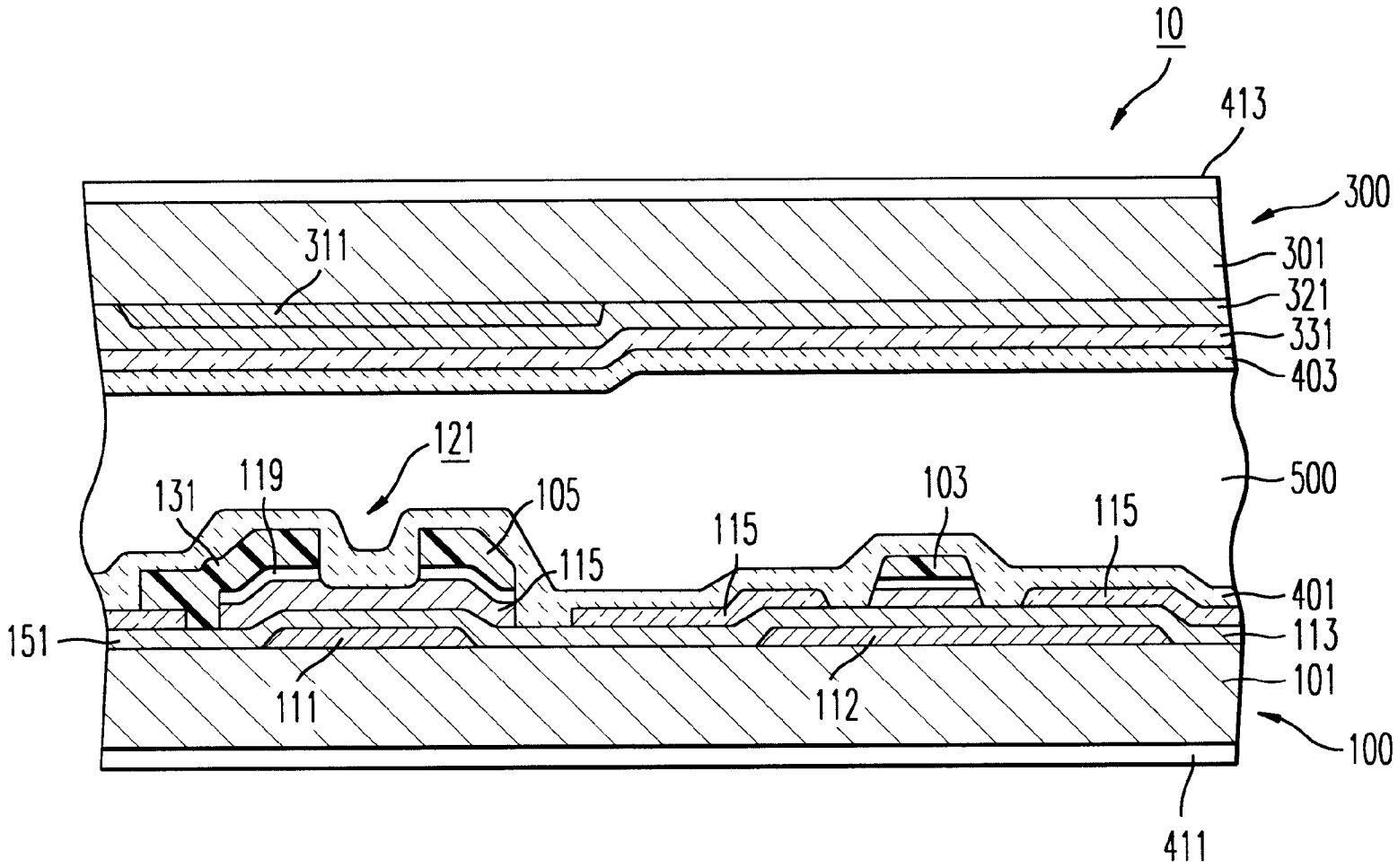
FIG. 1 is a sectional plane view of a liquid crystal panel of an embodiment of the liquid crystal display device to which the present invention is applied.

This active matrix type liquid crystal display device 1, as shown in FIG. 1, includes a normally-white mode liquid crystal display panel 10 providing an array substrate 100, a counter substrate 300, a TN liquid crystal layer 500 in a 5 micron thickness held between the substrates 100 and 300 through alignment layers 401 and 403, each of which is treated by a rubbing treatment and of which the rubbing directions cross each other, and rear and front polarizers disposed on outer surfaces of the substrates 100 and 300, each of which has a transparent axis parallel to the neighboring rubbing direction.

Figure 7:
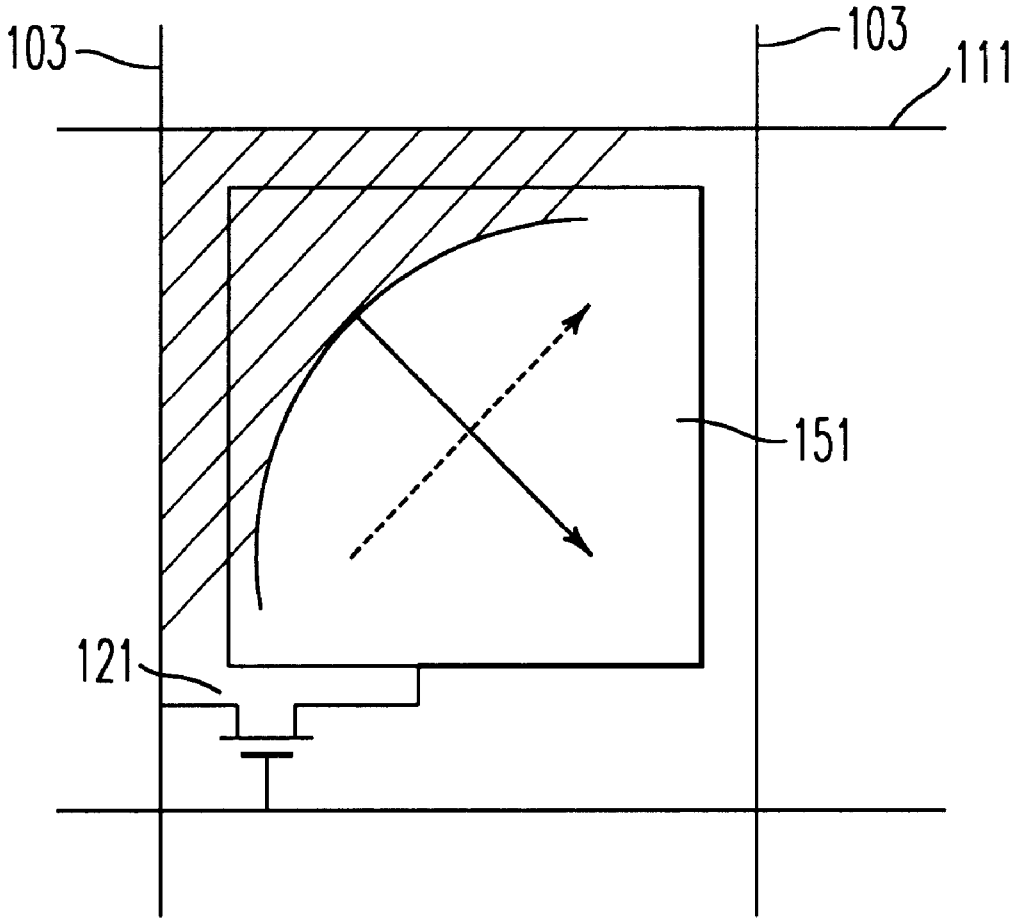
FIG. 7 is for explanation of a reverse image region in a display pixel.

The rubbing directions of the alignment layers 401 and 403 are similar to the directions shown in FIG. 7.

A liquid crystal material used in the liquid crystal panel 10 provides characteristics that a saturation voltage Vsat is 5.0 V and a threshold voltage Vth is 1.5 V. The saturation voltage Vsat indicates a voltage to accomplish a contrast ratio in 200. In this embodiment, as the liquid crystal display panel is a normally-white mode, the saturation voltage Vsat indicates a voltage to accomplish a transparent ratio in 0.5% where the transparent ratio in the white image state under the no electric potential difference between the electrodes is 100%. The threshold voltage Vth indicates a response start voltage of the liquid crystal material. In this embodiment, as the liquid crystal display panel is a normally-white mode, the threshold voltage Vth indicates a voltage to accomplish a transparent ratio in 90% where the transparent ratio in the white image state under the no electric potential difference between the electrodes is 100%.

Figure 2:
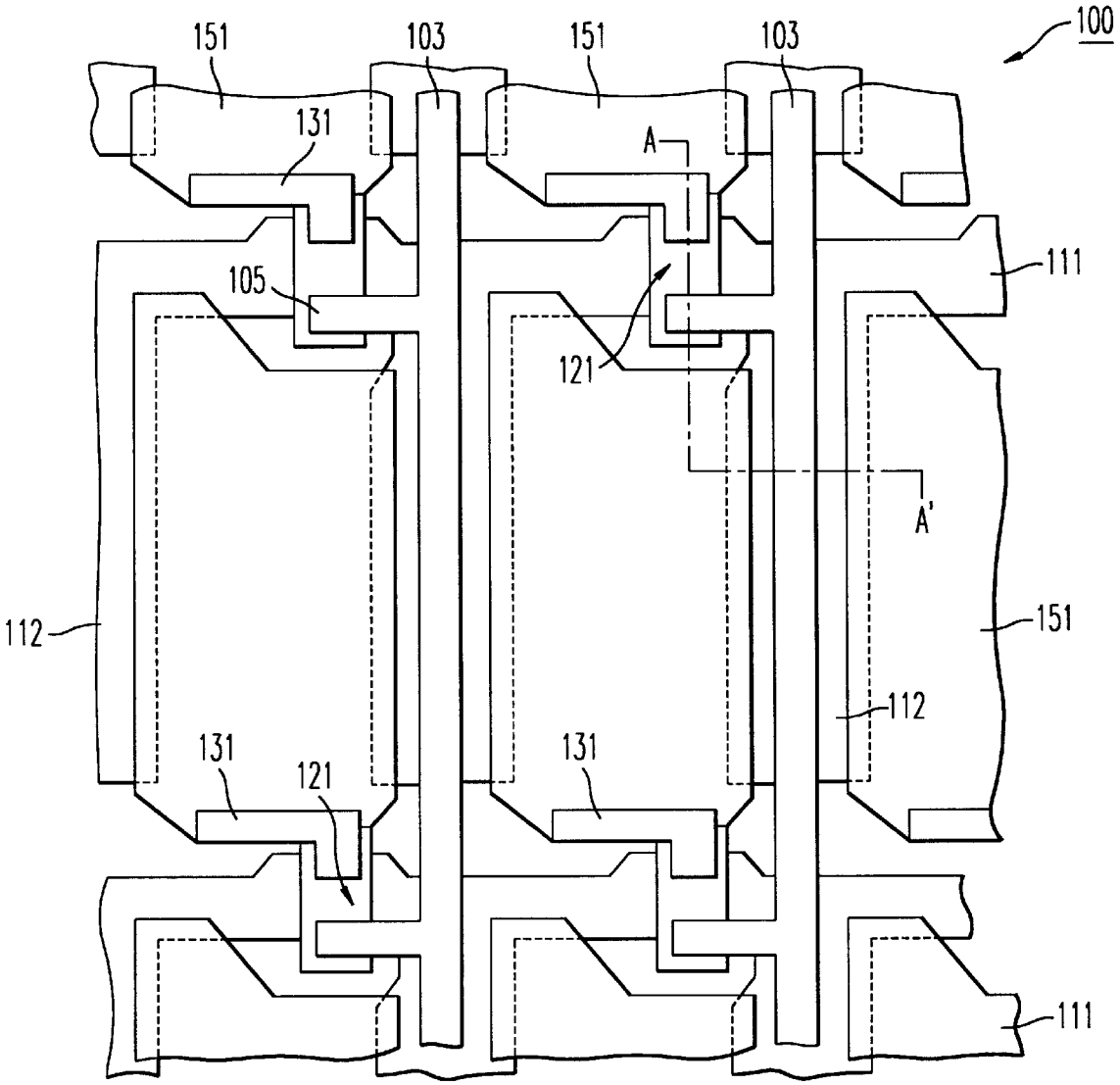
FIG. 2 is a front view of an array substrate in FIG. 1.

The array substrate 100, as shown in FIGS. 1 and 2, 640×3 numbers of signal lines 103 and 240 numbers of scanning lines 111 are disposed in a matrix form, and pixel electrodes 151 are disposed in the vicinity of the intersections between signal and scanning lines 103 and 111 through TFTs 121.

Each of the TFTs 121 provides a gate electrode constructed by the scanning line 111, an insulating layer 113, which is disposed on the scanning line 111, consisting of a silicon oxide (SiO2) layer and a silicon nitride (SiNx) layer laminated on the SiO2 layer, and a hydrogenated amorphous silicon (a-Si:H) layer as a semiconductor layer 115 disposed on the insulating layer 113. The semiconductor layer 115 is connected with the pixel electrode 151 via an n+type hydrogenated amorphous silicon as an ohmic contact layer 119 and a source electrode 131. And the semiconductor layer 115 is connected with the signal line 103 via an n+type hydrogenated amorphous silicon as an ohmic contact layer 119 and a drain electrode 105 extended from the signal line 103.

A storage capacitor Cs is constructed by the pixel electrode 151, a storage capacitor region 112 and a insulating layer 113 interposed therebetween, the storage capacitor region 112 extended from the scanning line 111 to the pixel electrode 151 and the gap between the signal line 103 and the pixel electrode 151, which is selected in the horizontal scanning period after the scanning line 111 is selected and overlapped with the peripheral portion of the pixel electrode 151.

The storage capacitor region 112 also acts to shield the lateral electric fields between the pixel electrode 151 and the signal line 103 neighboring to the pixel electrode 151.

In this embodiment, the storage capacitor region 112 is located between the neighboring pixel electrodes 151 across the signal line 103 so as to prevent the light from the gap between the pixel electrode 151 and the signal line 103. In this case, there can be happened an electric shortage between the storage capacitor region 112 and the pixel electrode 151, and a increase of signal and scanning line parasitic capacitance.

In order to prevent the electric shortage and the increase of parasitic capacitance, the storage capacitor region 112 should not be extended under the signal line 103, and a light shielding layer should be located so as to prevent the light form the gap between the signal line 103 and pixel electrode 151 or storage capacitor region 112.

The counter substrate 300 provides a strip shape light shielding layer 311, which is constructed with a chromium layer and a chromium oxide layer laminated on the chromium layer, so as to shield the light toward the TFTs 121 and the light from the gap between the scanning lines 111 and pixel electrodes 151. And further, a counter electrode 331 made of I.T.O. is located thereon via an insulating layer 321.

Figure 3:
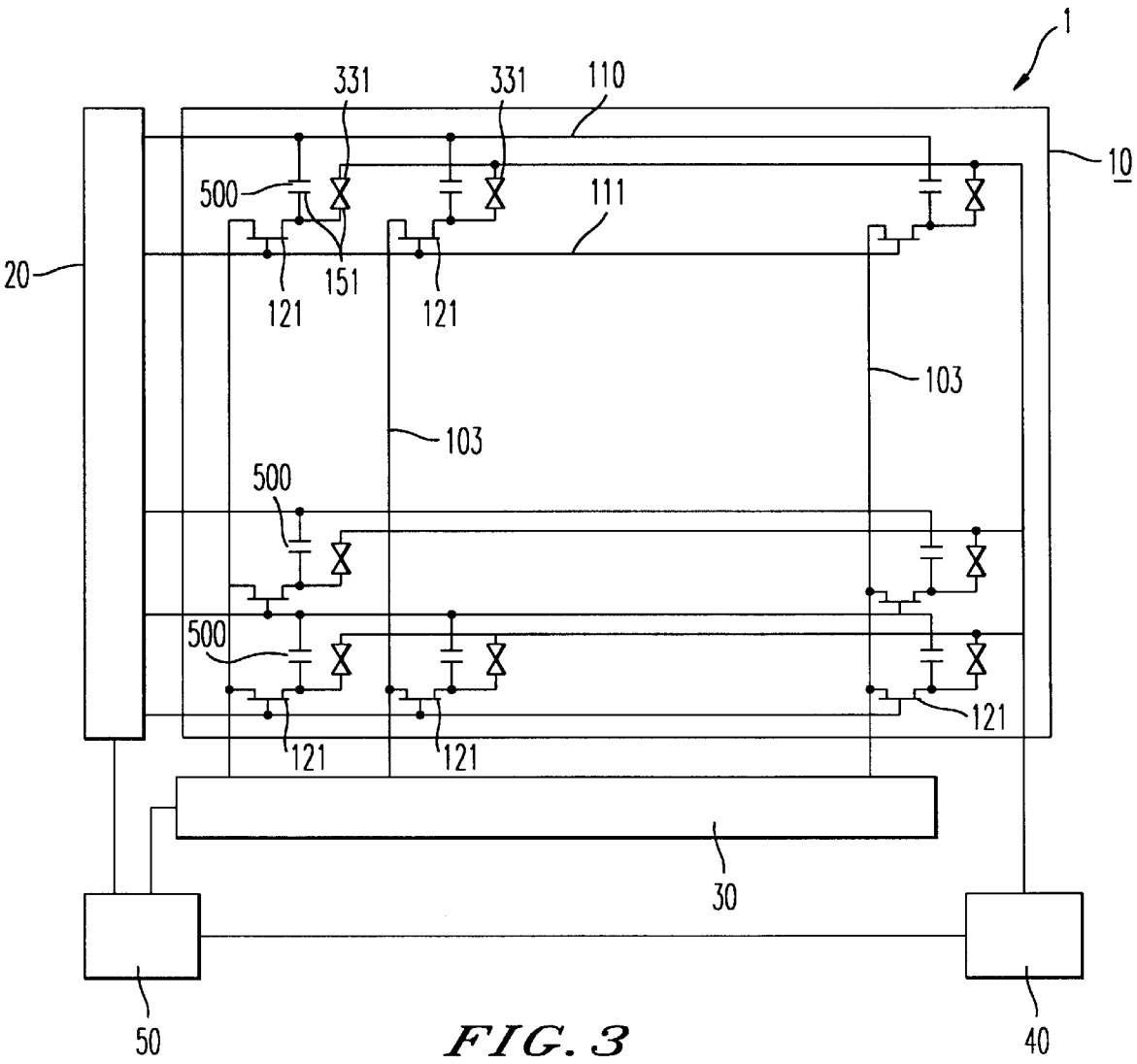
FIG. 3 shows a construction of one embodiment of the liquid crystal display device.
Figure 4:
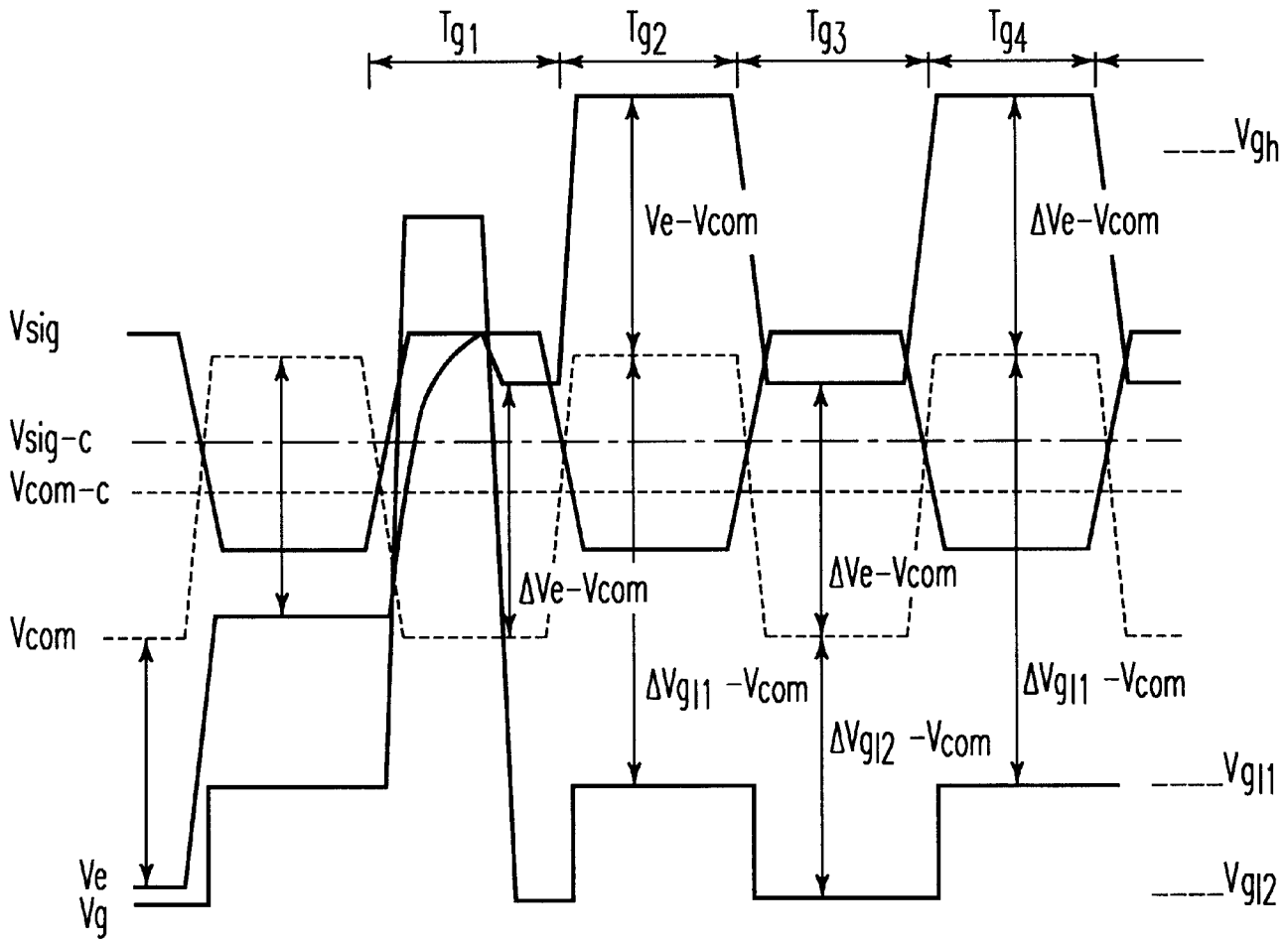
FIG. 4 shows driving waveforms of one embodiment of the liquid crystal display device.

As shown in FIGS. 3 and 4, the liquid crystal display device 1 provides a scanning line driver circuit 20 electrically connected with the scanning lines 111 of the liquid crystal panel so as to apply a scanning line voltage Vg to each scanning lines 111, a signal line driver circuit 30 electrically connected with the signal lines 103 of the liquid crystal panel so as to apply a signal voltage Vsig to each signal lines 103, a counter electrode driver circuit 40 electrically connected with the counter electrode 331 of the liquid crystal panel so as to apply a counter electrode voltage Vcom to the counter electrode 331, and a control circuit 60 for controlling the scanning line driver circuit 20, the signal line driver circuit 30 and the counter electrode driver circuit 40.

The pixel electrodes 151, which are positioned on the first stage in the upper side of FIG. 3, construct storage capacitors Cs with a dummy scanning line 110.

In this embodiment, a 1 H common inversion driving method, which is one of the driving method for decreasing the voltage amplitude, is introduced. In this 1 H common inversion driving method, the signal and counter electrode voltages Vsig and Vcom, are supplied, whose polarities are inverted to each reference voltages Vsig-c and Vcom-c in each horizontal scanning period method respectively.

The signal driver circuit 30 outputs the signal voltage Vsig of which the reference (center) voltage Vsig-c is +2.5 V, the amplitude is ±2.5 V to the reference voltage, and the polarity is inverted in each horizontal scanning periods to the reference voltage Vsig-c. The counter electrode driver circuit 40 outputs the counter voltage Vcom of which the reference voltage Vcom-c is +1.0 V, the amplitude is ±3.5 V to the reference voltage Vcom-c, and the polarity is inverted in each horizontal scanning periods to the reference voltage Vcom-c. In this embodiment, as the liquid crystal display device is the normally-white mode, the phase shift between the counter voltage Vcom and the signal voltage Vsig is adjusted at 180 degrees when a black raster image is displayed.

The scanning line driver circuit 20 selectively outputs the scanning line voltage Vg including three levels, the first of which is an ON-voltage Vgh for managing the ON state of the TFT 121: e.g. 18.0 V, the second of which is a first OFF-voltage Vgl1 for managing the OFF state of the TFT 121: e.g. −9.4 V, the third of which is a second OFF-voltage Vgl2 lower than the first OFF-voltage Vgl1 for managing the OFF state of the TFT 121: e.g. −14.0 V. The scanning line driver circuit 20 selectively applies the ON-voltage Vgh to each scanning lines 111 in each horizontal scanning periods of each vertical scaning periods in order. In the period except for selected period, the first and second OFF-voltages Vgl1 and Vgl2 are provided alternately in each horizontal scanning periods with the scanning lines 111. The phase of the scanning line voltage Vg during the holding periods is substantially as same as that of the counter electrode voltage Vcom.

FIG. 4 shows driving waveforms which relates to a display pixel displaying a black raster image. Regarding to the display pixel corresponding to the scanning line 111 selected during the horizontal scanning period Tg1, the scanning line driver circuit 20 sets up the scanning line 111 to the ON-voltage Vgh so as to manage the ON state of the TFT 121 in the horizontal scanning period Tg1.

Therefore, the signal voltage Vsig: e.g. +5.0 V is applied to the pixel electrode 151 through the TFT 121 corresponding to the display pixel. The counter electrode voltage Vcom: e.g. −2.5 V is applied to the counter electrode 331. Hence, the 7.5 V which is a potential difference Δ (Ve−Vcom) between the pixel electrode 151 and the counter electrode 331 is applied to the liquid crystal layer 300.

However, the pixel electrode potential Ve reduces about 1.0 V in accordance with redistributing the pixel electrode potential Ve to the storage capacitor Cs and the parasitic capacitances at the OFF timing of the TFT 121. Hence, the 6.5 V which is a potential difference Δ (Ve−Vcom) between the pixel electrode 151 and the counter electrode 331 is maintained in the liquid crystal layer 300, and the image can be displayed based on this potential difference.

In this embodiment, the amplitude Δ (Vgl1−Vgl2) of the scanning line voltage Vg during the holding period is sufficiently smaller than that of the counter electrode voltage Vcom. In this embodiment, for instance, the amplitude Δ (Vgl1−Vgl2) is about 4.6 V, and the amplitude of the counter electrode voltage Vcom is about 7.0 V. Therefore, in the horizontal scanning period Tg2 of the holding period, the potential difference Δ (Vgl1−Vcom) between the counter electrode 331 and scanning line 111 and storage capacitor region 112: e.g. 13.9 V is applied. In the horizontal scanning period Tg3 after the Tg2, the potential difference Δ (Vgl2−Vcom) between the counter electrode 331 and scanning line 111 and storage capacitor region 112: e.g. 11.5 V is applied, and after, this phenomenon is repeated during the holding period.

In other words, the alternating current voltage, of which cycle is formed of the two horizontal scanning periods, instead of the direct current voltage can be applied between the counter electrode 331 and scanning line 111 and storage capacitor region 112,.

Therefore, the occurrence of the reverse image regions under the influences of the lateral electric fields can be eliminated, because the charge up of the alignment layers is prevented and the vertical electric field during the long periods can be enough applied to the liquid crystal layer. Further more, as the difference between the potential difference Δ (Vgl1−Vcom) and Δ (Vgl2−Vcom), which is about 2.4 V in this embodiment, is lager than the threshold voltage Vth of the liquid crystal layer 500, which is about 1.5 V of this embodiment, the substantially alternating current voltage is applied to the liquid crystal layer 500. Therefore, it can be prevent that the impurity ions are stacking under the influences of the charge up, and the occurrence of the reverse image regions can be prevented.

Rising up the driving temperature, the reverse image regions can occur easily because of decreasing the viscosity of the liquid crystal layer 500.

For instance, where the difference between the first OFF-voltage Vgl1 and the counter electrode voltage Vcom is equal to the difference between the second OFF-voltage Vgl2 and the counter electrode voltage Vcom, and the constant direct current voltage is applied to the liquid crystal layer between the counter electrode and the storage capacitor region during the holding period, the occurrence of the reverse image regions is recognized under the high temperature environment; e.g. about 50 degrees and the size thereof is about 10 μm from the edge of the pixel electrode. As compared with above prior driving method, in this embodiment, the occurrence of the reverse image regions can not be recognized under the high temperature environment; e.g. about 70 degrees.

As mentioned above, in the driving method of this embodiment, when the black image is displayed, the 6.5 V which is a potential difference between the counter electrod voltage Vcom and the pixel electrode potential Ve is applied and maintained in the liquid crystal layer 300 during the holding period, because the pixel electrode potential Ve reduces about 1.0 V in accordance with redistributing the pixel electrode potential Ve to the storage capacitor Cs and the parasitic capacitance at the OFF timing of the TFT 121. And the potential difference between the first and second OFF-voltages Vgl1 and Vgl2 is different from the amplitude of the counter electrode voltage Vcom. And further, they are controlled so that the potential difference between the first and second OFF-voltages Vgl1 and Vgl2 is smaller than the amplitude of the counter electric voltage Vcom. Therefore, the potential difference Δ (Ve−Vcom), which is a little smaller than the 6.5V, is applied in the next horizontal scanning period Tg2 of the holding period because of the redistributing the electrical potential. The potential difference Δ (Ve−Vcom), which is substantially 6.5V, is applied in the next horizontal scanning period Tg3 of the holding period because of the redistributing of the electrical potential, and this phenomenon is repeated during each holding periods.

Practically, the liquid crystal molecules of the liquid crystal layer 300 respond with the average potential difference Δ (Ve−Vcom)of the holding period because the response of the liquid crystal molecules can not finish in each horizontal scanning periods. As compared with the prior driving method, the average potential difference Δ (Ve−Vcom) of the holding period of this embodiment is a little smaller than that of the prior driving method. Therefore, it is preferable to adjust the amplitude of the signal voltage Vsig to a little high in level, or to reduce the reference voltage Vcom-c of the counter electrode voltage in accordance with the difference between the potential difference Δ (Vgl1−Vcom) and the potential difference Δ (Vgl2−Vcom).

You can use the scanning line voltage Vg whose amplitude Δ (Vgl1−Vgl2) during holding periods is lager than that of the counter electrode voltage Vcom instead of this embodiment. In this way, it is necessary to adjust the amplitude of the signal voltage Vsig to be small in accordance with the difference between the potential difference Δ (Vgl1−Vcom) and the potential difference Δ (Vgl2−Vcom) under the consideration of practical voltage A (Ve-Vcom) which is a little larger than that of the prior driving method.

It is preferably that the amplitude of the counter electrode voltage Vcom is larger than that of the scanning line voltage Δ (Vgl1−Vgl2) during the holding period under the consideration of the leakage current of the OFF state of the TFT 121.

Figure 5:
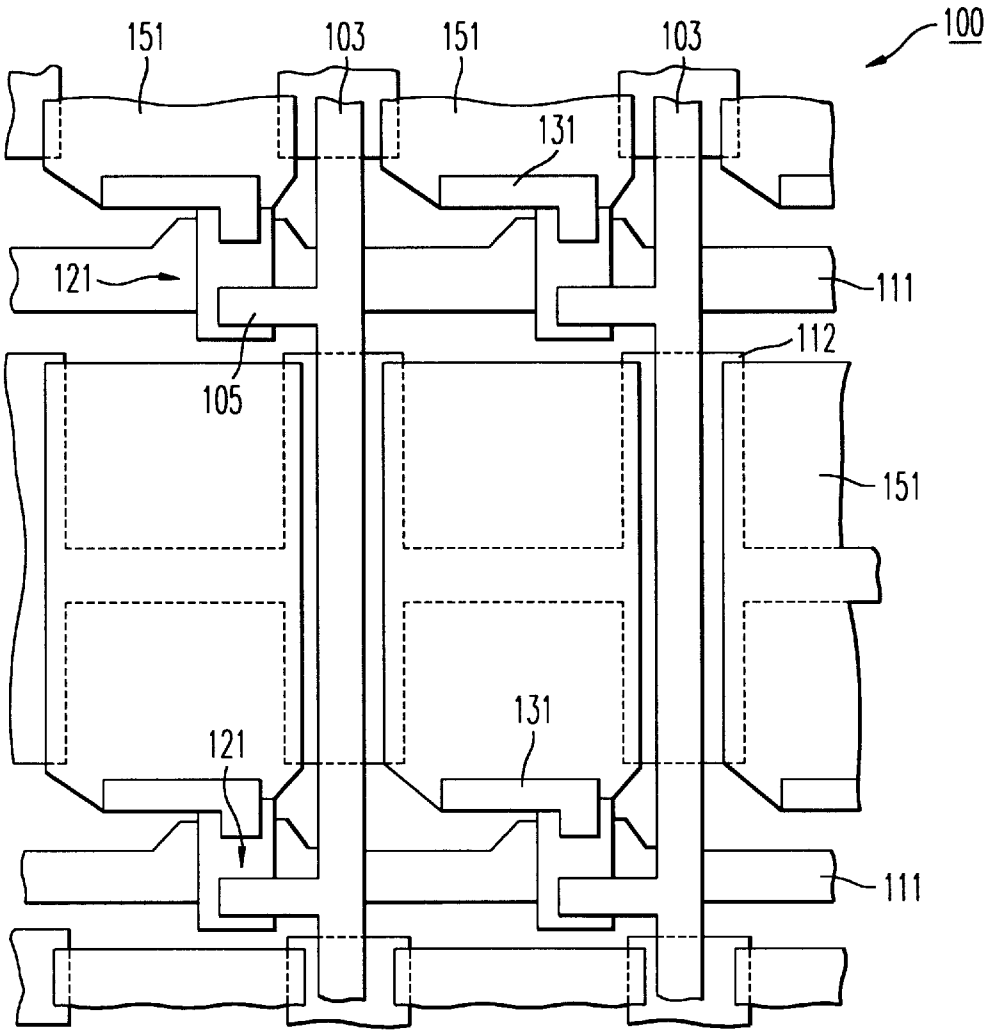
FIG. 5 shows a front view of an array substrate relating to another embodiment of this invention.

As mentioned above embodiment, the storage capacitor region 112 is extended from the scanning line 111 to the region between the pixel electrode 151 and signal line 103. However, the independent shield electrode 112 electrically insulated from the scanning line 111 and made by the same process of the scanning line 111 can be arranged, as shown in FIG. 5.

And the shielding electrode can be arranged between adjacent pixel electrodes 151 so as to prevent the lateral electric fields therebetween. And further more, the shielding electrode can be arranged between the scanning line 111 and the pixel electrode 151 adjacent thereto.

In this embodiment, we explain the liquid crystal display device introduced the 1 H common inversion driving method for the best mode embodiment. However, the 2 or 3 H common inversion driving method, or the flame inversion driving method may be used in this invention.

Now, we will explain another embodiment of this invention with figures. The construction of the liquid crystal display device relating to this embodiment is almost the same as that of the above embodiment except for the driving method. Therefore, we will only explain the differences therebetween.

In this embodiment, a HV inversion driving method which is one of the driving methods so as to reduce the flickers is introduced. The HV inversion driving method uses a signal voltage Vsig corresponding to a signal line 103 whose polarity is inverted to the reference voltage Vsig-c in each horizontal scanning periods, and a phase of the signal voltage Vsig applying to each signal line shifts 180 degrees to a phase of the signal voltage Vsig applying to the neighboring signal line 103.

For instance, the signal line driver circuit 30 outputs a signal voltage Vsig corresponding to a signal line 103, whose amplitude is in ±5 V and whose polarity is inverted to the reference voltage Vsig-c in each horizontal scanning periods.

The counter electrode driver circuit 40 outputs +4.0 V direct current voltage as a counter electrode voltage Vcom.

The scanning line driver circuit 20 selectively outputs the scanning line voltage Vg including three levels, the first of which is an ON-voltage Vgh so as to manage the ON state of the TFT 121: e.g. +23.0 V, the secod of which is a first OFF-voltage Vgl1 so as to manage the OFF state of the TFT 121: e.g. −5.0 V, the third of which is a second OFF-voltage Vgl2 lower than the first OFF-voltage Vgl1 so as to manage the OFF state of the TFT 121: e.g. −9.0 V. The scanning line driver circuit 20 selectively applies the ON-voltage Vgh to each scanning lines 111 in each horizontal scanning periods of each vertical scaning periods. In the period except for selected period, the first and second OFF-voltages Vgl1 and Vgl2 are provided alternately with the scanning lines 111 in each horizontal scanning periods.

Figure 6:
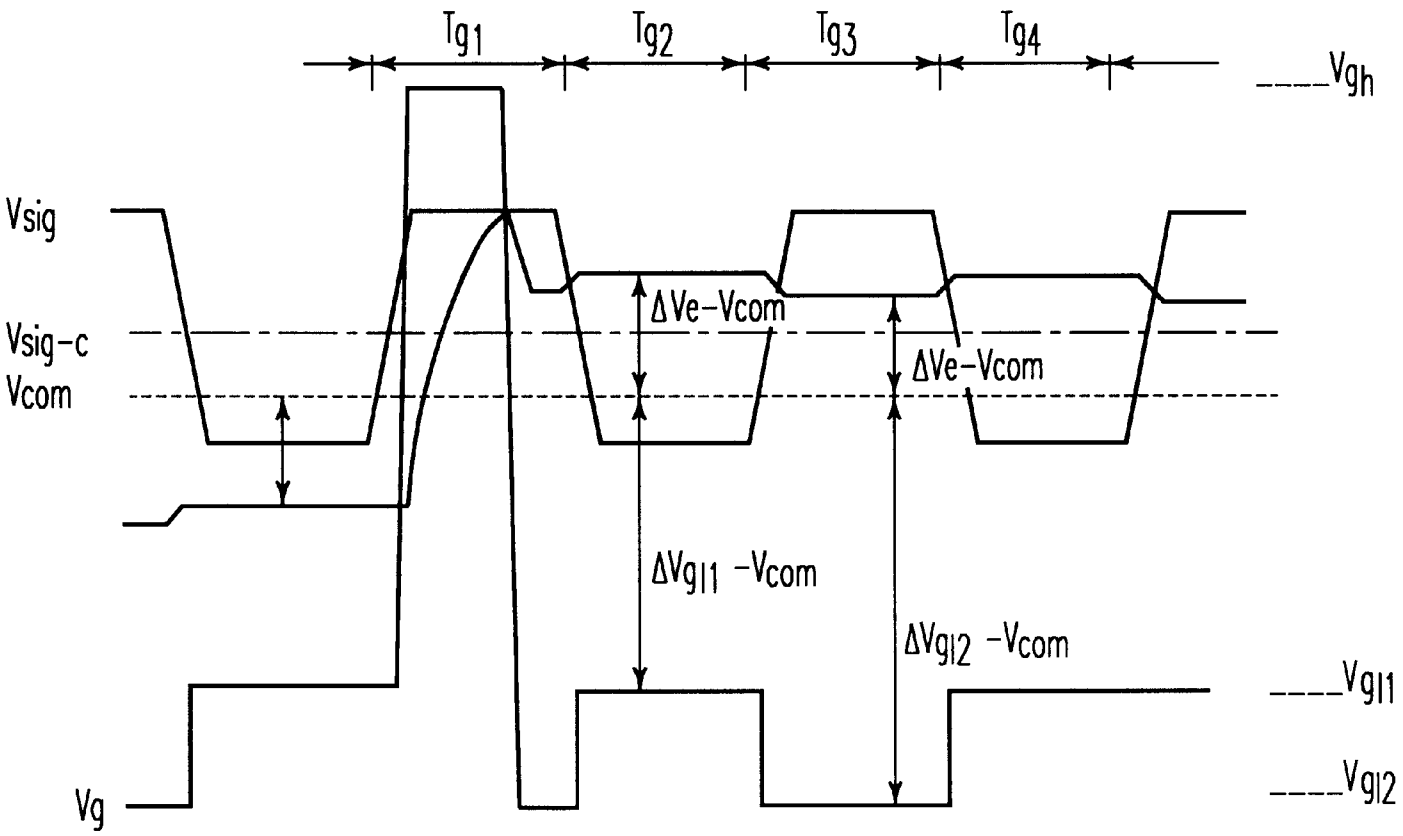
FIG. 6 shows driving waveforms of another embodiment of the liquid crystal display device.

FIG. 6 shows driving waveforms which relates to a display pixel displaying a black raster image. Regarding to the display pixel corresponding to the scanning line 111 selected during the horizontal scanning period Tg1, the scanning line driver circuit 20 sets up the scanning line 111 to the ON-voltage Vgh so as to be in the ON state of the TFT 121 in the horizontal scanning period Tg1.

Therefore, the signal voltage Vsig: e.g. +10.0 V is applied to the pixel electrode 151 through the TFT 121. The counter electrode voltage Vcom: e.g. +4.0 V is applied to the counter electrode 331. Hence, the 6.0 V which is a potential difference Δ (Ve−Vcom) between the pixel electrode 151 and the counter electrode 331 is applied to the liquid crystal layer 300.

However, the image is displayed in accordance with the +5.0 V which is the potential difference between the pixel and counter electrodes Δ (Ve−Vcom) during the holding period, because the pixel electrode potential Ve reduces about 1.0 V in accordance with redistributing the pixel electrode potential Ve to the storage capacitor Cs and the parasitic capacitances at the OFF timing of the TFT 121.

In this embodiment, the amplitude Δ (Vgl1−Vgl2) of the scanning line voltage Vg during the holding periods is about +4.0 V and the counter electrode voltage is always about +4.0 V.

Therefore, in this embodiment, for instance, the potential difference Δ (Vgl1−Vcom) between the counter electrode 331 and the scanning line 111 and the storage capacitor region 112 of the scanning line 111 is about 9.0 V during the horizontal scanning period Tg2. The potential difference Δ (Vgl2−Vcom) between the counter electrode 331 and the scanning line 111 and the storage capacitor region 112 of the scanning line is about 13.0 V during the horizontal scanning period Tg3 after the Tg2, and this phenomenon is repeated during each holding periods.

In other words, between the counter electrode 331 and scanning line 111 and storage capacitor region 112, the alternating current voltage, of which cycle is formed of the two horizontal scanning periods, instead of the direct current voltage can be applied.

Therefore, the occurrence of the reverse image regions under the influences of the lateral electric fields can not be happened, because the charge up of the alignment layers can be prevented and the vertical electric field during the long periods can be applied to the liquid crystal layer. Further more, as the difference between the potential differences Δ (Vgl1−Vcom) and Δ (Vgl2−Vcom), which is about 4.0 V in this embodiment, is lager than the threshold voltage Vth of the liquid crystal layer 500, which is about 1.5 V of this embodiment, the substantially alternating current voltage is applied to the liquid crystal layer 500 and it can be prevent that the impurity ions are stacking under the influences of direct current voltage. Therefor, the occurrence of the reverse image regions can be prevented.

Rising up the driving temperature, the reverse image regions can occur easily because of decreasing the viscosity of the liquid crystal layer 500.

In this embodiment, the occurrence of the reverse image regions can not be recognized under the high temperature environment; e.g. about 70 degrees as same as the above embodiment.

In this embodiment, when the black image is displayed, the 5.0 V which is a potential difference Δ (Ve−Vcom) between the pixel electrode 151 and the counter electrode 331 is applied and maintained in the liquid crystal layer 300 during the holding period, because the pixel electrode potential Ve reduces about 1.0 V in accordance with redistributing the pixel electrode potential Ve to the storage capacitor Cs and the parasitic capacitance at the OFF timing of the TFT 121.

The first OFF voltage Vgl1 is different from the second OFF voltage Vgl2, and the counter electric voltage Vcom is the direct current voltage. In other words, their voltages are controlled so that the difference between the first and second OFF-voltages Vgl1 and Vgl2 is smaller than the amplitude of the counter electrode voltage Vcom. Therefore, the voltage Δ (Ve−Vcom), which is a little larger than the 5.0 V, is applied in the next horizontal scanning period Tg2 during the holding period because of the redistribute of the pixel electrode potential. The voltage Δ (Ve−Vcom),which is substantially 5.0 V, is applied in the next horizontal scanning period Tg3 during the holding period because of the redistribute of the pixel electrode potential, and this phenomenon is repeated during each holding periods. Practically, the liquid crystal molecules of the liquid crystal layer 300 respond with the average voltage Δ (Ve−Vcom) because the response of the liquid crystal molecules can not finish in each horizontal scanning periods. Therefore, as compared with the prior driving method, the voltage applied to the liquid crystal layer 300 of this embodiment is larger than that of the prior driving method. Therefore, it is preferable to adjust the amplitude of the signal voltage Vsig to a little low in level, or to reduce the counter electrode voltage Vcom in accordance with the difference between the potential difference Δ (Vgl1−Vcom) and the potential difference Δ (Vgl2−Vcom).

As compared with the above embodiment, it is necessary to use the high protective voltage semiconductor element for the driver circuits so that the amplitude of the signal voltage Vsig is large: e.g. about ±5.0 V. However, this embodiment has an advantages that the occurrence of the flickers in display image is prevented efficiently.

In this embodiment, the electrical potential shifts of the pixel electrodes under the influences of the electrical coupling between the pixel electrodes and the signal lines adjacent thereto are compensated because the polarity of the signal voltage Vsig is opposite to the polarity of the neighboring signal voltage Vsig. Therefore, the flickers in the display image are eliminated.

In this embodiment, we has explained about the active matrix type liquid crystal display device using a inverted staggered type TFT as a switching element which includes an a-Si:H film as a semiconductor layer. This invention may also be used for the liquid crystal display device using a staggered type TFT as the switching element, using a poly-crystalline silicon film as a semiconductor layer, and using an array substrate including a driver circuit at the peripheral potions thereof.

What we claim is:

1. A liquid crystal display device comprising:

an array substrate having a plurality of signal lines, a plurality of scanning lines crossing to the signal lines, switching elements disposed at each crossing points of the signal and scanning lines, the switching element connected with one of the signal lines and one of the scanning lines, pixel electrodes each connected with one of the switching elements;

a counter substrate having a counter electrode opposed to the pixel electrodes;

a liquid crystal layer including liquid crystal molecules disposed between the array and counter substrates;

a first and second alignment layers, said first alignment layer disposed between the array substrate and the liquid crystal layer, said second alignment layer disposed between the counter substrate and the liquid crystal layer, and each alignment layers treated so as to apply a predetermined pre-tilt angle to the liquid crystal molecules;

a signal line driver circuit applying signal voltages to each signal lines;

a scanning line driver circuit applying scanning voltages to each scanning lines;

a counter electrode driver circuit applying a counter electrode voltage to the counter electrode;

a shield electrode disposed in a region applied a lateral electric field which is against a direction of the pre-tilt angle; and control means for adjusting a potential difference between the shield electrode and the counter electrode to a first potential difference during a first period, and adjusting the potential difference between the shield electrode and the counter electrode to a second potential difference, which is smaller than the first potential difference, during a second period continuing after the first period.

2. The liquid crystal display device according to claim 1, wherein the shield electrode is extended from one of the scanning lines to one of the pixel electrodes, the one of the pixel electrodes is connected with another one of the scanning lines neighboring to the one of the scanning lines via the switching element.

3. The liquid crystal display device according to claim 1, wherein the scanning line driver circuit outputs the scanning voltages whose waveform has a first level so as to be ON state to the switching elements, a second level so as to be OFF state to the switching elements, and a third level so as to be OFF state to the switching elements, the second and third level are different in level.

4. The liquid crystal display device according to claim 3, wherein the counter electrode driver circuit outputs a waveform having a forth level and a fifth level different from the forth level, the forth and fifth levels are alternated in each horizontal scanning periods.

5. The liquid crystal display device according to claim 4, wherein the second and third levels of the scanning voltage are alternatevely outputted in accordance with each horizontal scanning periods by turns.

6. A method of driving a liquid crystal display device including an array substrate having a plurality of pixel electrodes in a matrix form, a counter substrate having a counter electrode opposed to the pixel electrodes, a liquid crystal layer including liquid crystal molecules disposed between the array and counter substrates, a first and second alignment layers, said first alignment layer disposed between the array substrate and the liquid crystal layer, said second alignment layer disposed between the counter substrate and the liquid crystal layer, and aligment layers treated so as to apply a predetermined pre-tilt angle to the liquid crystal molecules, and a shield electrode disposed in a region applied a lateral electric field which is against a direction of the pre-tilt angle, comprising the steps of:

applying a signal voltageat least one of the pixel electrodes in each perditermined periods and applying a counter electrode voltage to the counter electrode;

holding potential difference between the one of the pixel electrodes and the counter electrode during each predetermined holding periods; and displaying an image corresponding to the potential difference;

wherein a potential difference between the shield electrode and the counter electrode is adjusted to a first potential difference during a first period, and the potential difference between the shield electrode and the counter electrode is adjusted to a second potential difference, which is smaller than the first potential difference, during a second period continuing after the first period.

7. The method of driving a liquid crystal display device according to claim 6, wherein the first and second periods are shorter than ten holding periods.

8. The method of driving a liquid crystal display device according to claim 7, wherein each of the first and second periods is corresponding to a horizontal scanning period respectively.

9. The method of driving a liquid crystal display device according to claim 6, wherein the array substrate includes a plurality of signal and scanning lines, one of the signal lines and one of the scanning lines are connected with a switching element respectively.

10. The method of driving a liquid crystal display device according to claim 9, wherein the shield electrode is extended from one of the scanning lines to one of the pixel electrodes, the one of the pixel electrodes is connected with another one of the scanning lines neighboring to the one of the scanning lines via the switching element.

11. The method of driving a liquid crystal display device according to claim 10, wherein the shield electrode is overlapped with a peripheral portion of at least one of the pixel electrodes via an insulating layer so as to form a storage capacitor.

12. The method of driving a liquid crystal display device according to claim 6, wherein the counter electrode voltage is alternated at least in each vertical scanning periods, and a alternating current voltage of which phase is substantially equal to that of the counter electrode voltage is applied to the shield electrode.

13. The method of driving a liquid crystal display device according to claim 6, wherein the counter electrode voltage is alternated at least in each horizontal scanning periods, and a alternating current voltage of which phase is substantially equal to that of the counter electrode voltage is applied to the shield electrode.

14. The method of driving a liquid crystal display device according to claim 12, wherein an amplitude of the alternating current voltage is smaller than that of the counter electrode voltage.

15. The method of driving a liquid crystal display device according to claim 6, wherein a threshold voltage of the liquid crystal layer is smaller than a difference between the first and second potential differences.

16. The method of driving a liquid crystal display device according to claim 6, wherein the counter electrode voltage is a direct current voltage, and an alternating current voltage whose polarity is inverted to a reference voltage at least in each vertical scanning periods is applied to the shield electrode.

* * * * *